US008870491B2

(12) United States Patent
Lemons et al.

(10) Patent No.: US 8,870,491 B2
(45) Date of Patent: Oct. 28, 2014

(54) SYSTEM AND METHOD FOR GOLF COURSE CART PATH CONSTRUCTION

(76) Inventors: Gerald Lynn Lemons, Old Hickory, TN (US); William Robert Fuller, Atlanta, GA (US)

( * ) Notice: Subject to any disclaimer, the term of this patent is extended or adjusted under 35 U.S.C. 154(b) by 0 days.

(21) Appl. No.: 13/424,321

(22) Filed: Mar. 19, 2012

(65) Prior Publication Data

US 2012/0237296 A1 Sep. 20, 2012

Related U.S. Application Data

(60) Provisional application No. 61/454,506, filed on Mar. 19, 2011.

(51) Int. Cl.

| | |
|---|---|
| ***E01C 7/32*** | (2006.01) |
| ***E01C 19/17*** | (2006.01) |
| ***E01C 11/00*** | (2006.01) |
| ***E01C 13/06*** | (2006.01) |

(52) U.S. Cl.

CPC ..... *E01C 19/174* (2013.01); *E01C 7/32* (2013.01); *E01C 11/005* (2013.01); *E01C 13/065* (2013.01)

USPC ..... 404/75; 404/17; 404/27; 404/31

(58) Field of Classification Search

CPC ..... E01C 11/005; E01C 7/32

USPC ..... 404/17, 18, 31, 37–43, 72, 75, 2, 4

See application file for complete search history.

(56) References Cited

U.S. PATENT DOCUMENTS

| | | | | |
|---|---|---|---|---|
| 3,690,227 | A * | 9/1972 | Welty et al. | 404/2 |
| 3,837,168 | A * | 9/1974 | Alsberg et al. | 405/50 |
| 3,910,710 | A * | 10/1975 | Gagle et al. | 404/28 |
| 4,449,098 | A * | 5/1984 | Nakamura et al. | 324/326 |
| 4,609,303 | A * | 9/1986 | Shumaker | 404/105 |
| 4,913,596 | A * | 4/1990 | Lambert, III | 405/43 |
| 5,788,407 | A * | 8/1998 | Hwang | 404/81 |
| 6,095,718 | A * | 8/2000 | Bohnhoff | 405/52 |
| 7,033,104 | B2 * | 4/2006 | Corcoran | 404/77 |
| 7,104,724 | B2 * | 9/2006 | Terry | 404/110 |
| 7,357,594 | B2 * | 4/2008 | Takamura | 404/75 |
| 2002/0101004 | A1 * | 8/2002 | Farris et al. | 264/211 |
| 2003/0177799 | A1 * | 9/2003 | Park et al. | 71/903 |
| 2009/0114749 | A1 * | 5/2009 | Futa | 241/30 |
| 2011/0200518 | A1 * | 8/2011 | MacIntosh et al. | 423/449.7 |
| 2013/0011195 | A1 * | 1/2013 | Bower et al. | 404/31 |
| 2013/0216704 | A1 * | 8/2013 | Brien | 427/136 |

* cited by examiner

*Primary Examiner* — Raymond W Addie

(74) *Attorney, Agent, or Firm* — James M Smedley LLC; James M. Semedley, Esq.

(57) ABSTRACT

A system and method for building and renovating golf course paths to provide an alternate golf cart path with a drainage system and durable natural path for golf. A drainage system and a layer of gravel is installed over the entire sub grade of the path. A layer of crumb rubber is placed over the gravel. A pre-polymer is sprayed onto the layer of crumb rubber and gravel to secure it in place. The polymer sprayed is permitted to cure for approximately 24-48 hours.

6 Claims, 5 Drawing Sheets

SYSTEM AND METHOD FOR GOLF COURSE CART PATH CONSTRUCTION

CROSS REFERENCE TO RELATED APPLICATIONS

This application claims the benefit of U.S. Provisional Patent Application No. 61/454,506 Filed Mar. 19, 2011, the entire disclosure of which is incorporated herein by reference.

FIELD OF THE INVENTION

The present invention relates generally to walking trails, golf cart paths and light equipment trails. More particularly, the present invention relates to a system and method for construction of a golf course path to provide an alternate to concrete or asphalt paths.

BACKGROUND

It is a known fact in the golf industry of the demand for alternate golf course paths that are more natural looking and still cost effective. Golf courses spend an enormous amount of money and resources on concrete and asphalt paths that have short life spans and are unsightly for golfers and golf course architects. Golf course owners want an alternate that is affordable and durable.

One problem associated with concrete and asphalt is it is not natural looking and golfers are searching for an alternate. Concrete paths crack and have an average lifespan of only 10 years while asphalt paths can sometimes only endure for 5 years before they look unsightly and become rough and less appropriate for their intended purposes.

Another problem is cost. Alternatives to concrete or asphalt cart paths can be very expensive. Thick layers of crumb rubber have been used in numerous applications, including playgrounds and light paths. However, the only method for installation is by mixing a polymer and crumb rubber in a concrete type mixing device, smoothing and placing by hand the mixed material and then trawling the placed mixed material. A thick layer of crumb rubber/polymer is required in this method, making it prohibitively expensive.

Almost all techniques of path use a base of stone for support but no prior art has used a layer of stone and thin layer of crumb rubber that is sprayed with a polymer to created an inexpensive and durable path.

Therefore, there is a need in the art for a system and method for creating an inexpensive and durable golf course cart path that can withstand the tests of time. These and other features and advantages of the present invention will be explained and will become obvious to one skilled in the art through the summary of the invention that follows.

SUMMARY OF THE INVENTION

Accordingly, it is an object of the present invention to provide a unique system and method for the construction and/or repair of golf course cart paths, walkways and light equipment trails where an alternate for concrete and asphalt is desired and to provide a system and method for the construction and/or improvement of alternate paths.

According to another embodiment of the present invention, a system for golf course cart path construction includes: a pre-polymer container; a pre-polymer container heater connected to said pre-polymer container in such a manner that allows for the pre-polymer container heater to heat contents of said pre-polymer container; a power source connected to said pre-polymer container heater such that said power source can provide power to said pre-polymer container heater; a diaphragm pump; a suction hose, wherein said suction hose connects the pre-polymer container to the diaphragm pump such that contents of the pre-polymer container can be passed through the suction hose and into the diaphragm pump;

a spray wand; and a dispenser hose, wherein said dispenser hose connects the diaphragm pump to said spray wand such that said contents of the pre-polymer container can be passed through the diaphragm pump and into the spray wand, wherein the spray wand is configured to allow the even dispersing of said contents of said pre-polymer container onto a golf course cart path.

According to another embodiment of the present invention, the diameter of said suction hose is at least one inch.

According to another embodiment of the present invention, the diameter of said dispenser hose is at least one inch.

According to another embodiment of the present invention, the pre-polymer heater is configured to heat said contents of said pre-polymer container to a temperature greater than 70 degrees Fahrenheit.

According to another embodiment of the present invention, a method for creating a pathway includes the steps of: preparing a sub grade; excavating one or more drainage trenches in said sub grade; installing one or more perforated drain pipes in said one or more drainage trenches; surrounding at least a portion of each of said one or more perforated drain pipes by pea gravel; layering said sub grade, said one or more drainage trenches and said one or more perforated drain pipes with a layer of gravel; compacting said layer of gravel; layering, over said layer of gravel, a thin layer of crumb rubber; raking said thin layer of crumb rubber; smoothing said thin layer of crumb rubber; rolling said thin layer of crumb rubber; and spraying said thin layer of crumb rubber with the pre-polymer.

According to another embodiment of the present invention, each of said one or more drainage trenches are wide enough for receiving said one or more perforated drain pipes.

According to another embodiment of the present invention, each of said one or more perforated drain pipes comprises a four inch or greater drainage pipe.

According to another embodiment of the present invention, the method is further comprised of the step of attaching a locating wire to each of said one or more perforated drain pipes.

According to another embodiment of the present invention, the locating wire is a fourteen gauge wire and is configured to allow later location of the one or more perforated drain pipes.

According to another embodiment of the present invention, the spraying step is accomplished through the use of a sprayer system, including the components of: a pre-polymer container; a pre-polymer container heater connected to said pre-polymer container in such a manner that allows for the pre-polymer container heater to heat contents of said pre-polymer container; a power source connected to said pre-polymer container heater such that said power source can provide power to said pre-polymer container heater; a diaphragm pump; a suction hose, wherein said suction hose connects the pre-polymer container to the diaphragm pump such that contents of the pre-polymer container can be passed through the suction hose and into the diaphragm pump; a spray wand; and a dispenser hose, wherein said dispenser hose connects the diaphragm pump to said spray wand such that said contents of the pre-polymer container can be passed through the diaphragm pump and into the spray wand.

It is another object of the present invention to provide a system and method that utilizes the cleaver technique to use a rock layer as a conduit for drainage, covered with a layer of crumb rubber that, when sprayed with a single component polymer, forms an almost permanent and attractive path. Therefore, the systems and methods herein described are directed at substantially reducing the required maintenance and fast replacement cycle of golf course cart paths and other paths for use by pedestrians or light vehicles.

According to another embodiment of the present invention, a system and method for repairing failing cart paths is disclosed, whereby a thin layer of crumb rubber and polymer can be reapplied to "renew the path" when needed for a fraction of the cost and time.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

Referring to the drawings, wherein like reference numerals are used to designate like parts.

DETAILED SPECIFICATION

Figure 1:
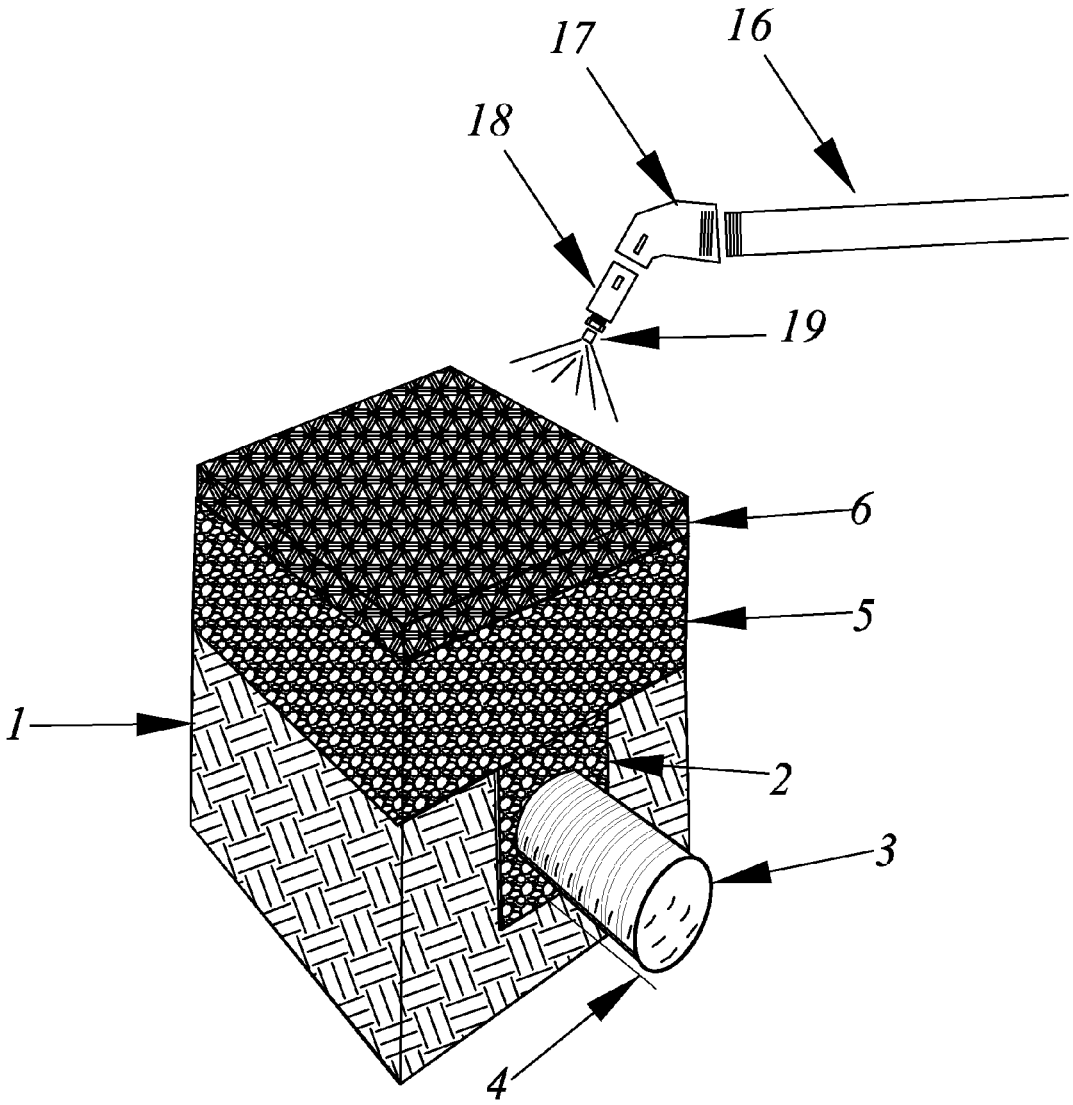
FIG. 1 is a perspective profile view of a preferred embodiment of the present invention showing a cross section of the lower portion of the path away from the edges and a specially designed pressure spray system.
Figure 2:
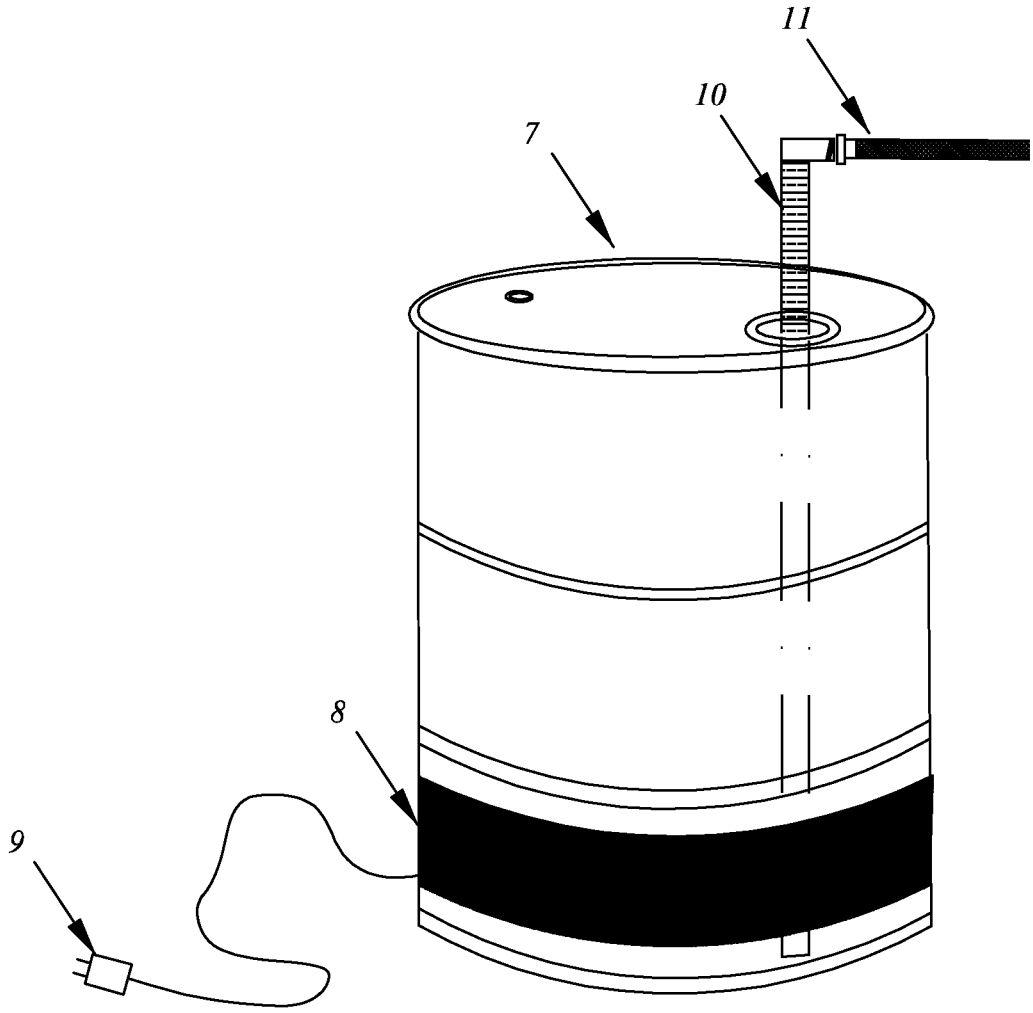
FIG. 2 is a view of a portion of an exemplary embodiment of a specially designed pressure spray system, in accordance with the present invention.
Figure 3A:
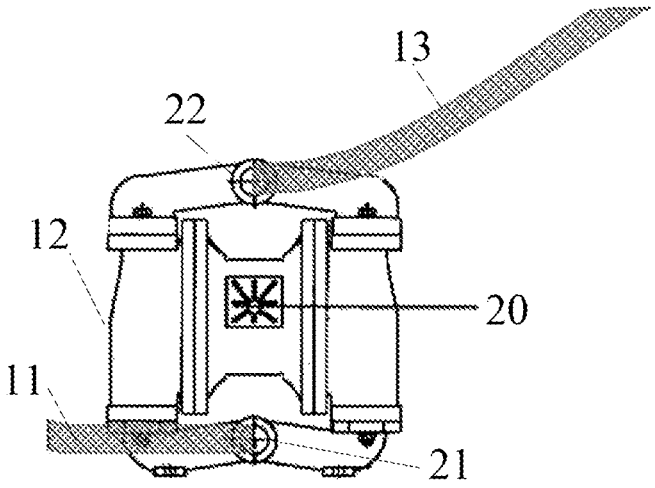
FIG. 3A is a front view of a portion of an exemplary embodiment of a specially designed pressure spray system, in accordance with the present invention.
Figure 3B:
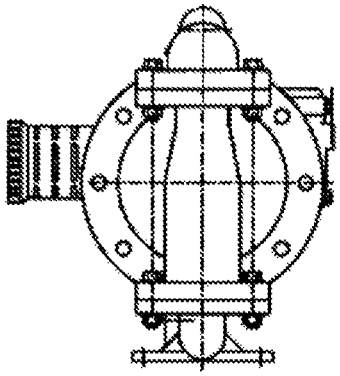
FIG. 3B is a side view of a portion of an exemplary embodiment of a specially designed pressure spray system, in accordance with the present invention.
Figure 3C:
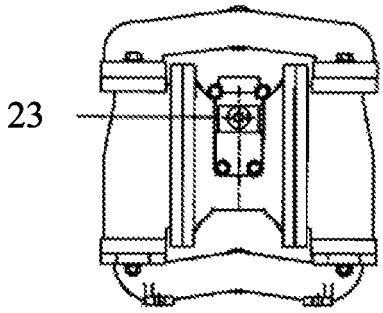
FIG. 3C is a rear view of a portion of an exemplary embodiment of a specially designed pressure spray system, in accordance with the present invention.
Figure 3D:
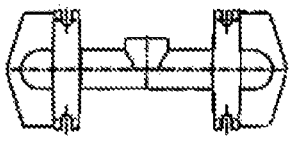
FIG. 3D is a top view of a portion of an exemplary embodiment of a specially designed pressure spray system, in accordance with the present invention.
Figure 4:
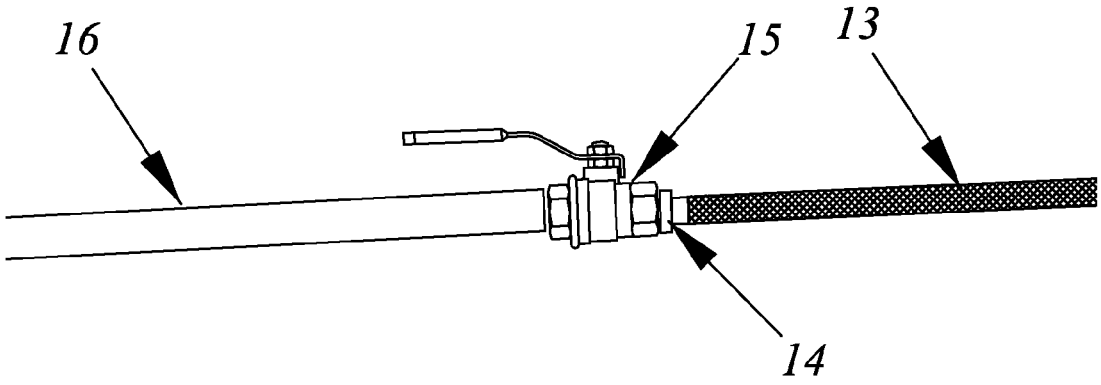
FIG. 4 is a view of a portion of an exemplary embodiment of a specially designed pressure spray system, in accordance with the present invention.

The present invention relates generally to walking trails, golf cart paths and light equipment trails. More particularly, the present invention relates to a system and method for construction of a golf course path to provide an alternate to concrete or asphalt paths. In accordance with various forms of the present invention, a plurality of methods and materials are provided for treating golf course paths.

According to an embodiment of the present invention, a subgrade of the path is graded smooth and prepared for stone. Any local stone used for road construction can be used as base making this method cost efficient. In an exemplary embodiment, a ¼"-¾" single washed stone is utilized. One of ordinary skill in the art would appreciate that numerous types of stones could be utilized with embodiments of the present invention, and embodiments of the present invention are contemplated for use with any type of stones.

According to an embodiment of the present invention, the subgrade of the path, where required in low or flat areas, may have an excavated drainage trench that is wide enough so a perforated drain pipe can be installed and surrounded by gravel. In an exemplary embodiment of the present invention, a four-inch or greater perforated drain pipe with slots could be installed in one or more trenches and surrounded by, for example, pea gravels. Ideally, gravel should be similar to specifications used in the industry for French drains, but most all clean pea gravels may work well. In an exemplary embodiment, a locater wire would then be laid and connected in the trench with the perforated drain pipe system.

According to an embodiment of the present invention, a layer of gravel should be placed over the entire floor of the path 3-4" deep. The gravel should be brought up to the edge of the path, rolled and compacted. The gravel selected may be tested by an accredited soils lab for bridging with the selected crumb rubber. This common criterion is based on engineering principles that rely on the largest 15% of the crumb rubber particles "bridging" with the smallest 15% of the gravel particles.

At this point, a thin layer of crumb rubber is placed over the gravel and rolled with a heavy roller for smoothness. The crumb rubber is placed thick enough to cover the stone completely. Thereafter, a DOW PRE-POLYMER or other similar pre-polymer is sprayed using a specially designed pressure spray system to all areas of the path. The specially designed pressure spray system is designed to handle the pre-polymer and allow for even distribution of pre-polymer on the crumb rubber and rock.

According to an embodiment of the present invention, the treated path is allowed to cure for approximately 24-48 hours. After the curing time has elapsed, a more natural and durable path with superior drainage stability is produced.

Turning now to FIGS. 1-4, an exemplary embodiment of a specially designed pressure spray system is shown. According to an embodiment of the present invention, the specially designed pressure spray system is comprised of one or more of a drum of pre-polymer 7, a drum band heater 8, a power source 9, a pipe or tube system 10, a suction hose 11, a diaphragm pump 12 (e.g., Ingersol Rand PD10A-AAP-FST), a dispenser hose 13, a swivel 14, and a spray wand (comprised of components 17, 18, 19). The diaphragm pump may be comprised of (as shown in FIGS. 3A-3D) an air exhaust 20, an inlet connection 21, an outlet connection 22 and an air supply 23. One of ordinary skill in the art would appreciate that numerous elements of the present invention may be substituted or removed entirely, depending on the particular need, purpose or application. For instance, the drum of pre-polymer 7 may be replaced by any other container suitable for containing and transporting pre-polymer, including smaller can or drum style containers and larger vehicle based containers. One of ordinary skill in the art would appreciate that there are numerous containers that could be utilized with embodiments of the present invention, and embodiments of the present invention are contemplated for use with any container. Where a container is not a drum, the drum band heater is replaced with a heater of appropriate size and thermal characteristics capable of appropriately heating the pre-polymer in a manner as described herein. For instance, the pre-polymer container heater may be required to heat the pre-polymer to a temperature of above 70 degrees Fahrenheit.

According to an embodiment of the present invention, the hose elements (i.e., suction hose, dispenser hose) are not required to be hoses, but any other tubing that is appropriate for the transmission of the pre-polymer there through. For instance, the hose element could be comprised of a piping system (e.g., one or more interconnected pipes), a tubing system (e.g., one or more tubes) or a flexible pathway means. One of ordinary skill in the art would appreciate that there are numerous flexible pathway means that could be utilized with embodiments of the present invention, and embodiments of the present invention are contemplated for use with any flexible pathway means.

According to an embodiment of the present invention, the power source 9, could be comprised of one or more of a battery, a AC power supply, a DC power supply or other power providing means (e.g., gas powered generator). One of ordinary skill in the art would appreciate that there are numerous power sources that could be utilized with embodiments of the present invention, and embodiments of the present invention are contemplated for use with any type of power source.

According to an embodiment of the present invention, the pathway from the drum of pre-polymer 7 to the spray wand would be of an appropriate diameter to allow for the pre-polymer to pass through the pathway. For instance, all of the components of the specially designed pressure spray system may have a channel that is at least one inch in diameter. One of ordinary skill in the art would appreciate that there are numerous appropriate pathway diameters that could be utilized with embodiments of the present invention, and embodiments of the present invention are contemplated for use with any appropriate pathway diameter.

According to an embodiment of the present invention, depending on the particular pre-polymer utilized and surface to be sprayed, a band heater 8 may be utilized to heat the pre-polymer to an appropriate temperature for use. For instance, certain pre-polymers work best with the specially designed pressure spray system when heated to a temperature above 70 degrees Fahrenheit.

Referring now to FIG. 1, a sub grade 1 and an one or more excavated drainage trenches 2 that are wide enough for a perforated drain pipe 3 to be installed and surrounded by gravel, are shown. A common four inch or greater drainage pipe with slots 3 is installed in the trenches and surrounded by pea gravel. A common insulated fourteen gauge wire 4 is used for locating the pipe in the future. A layer of gravel 5 is placed over the entire path and compacted. A thin layer of crumb rubber 6 is placed on the rock layer and raked smooth and rolled. The top of the gravel 5 and crumb rubber 6 are sprayed with the PRE-POLYMER or similar sprays. The specially designed pressure sprayer is used to apply the PRE-POLYMER or other similar sprays.

While the methods discussed above have been aimed at the creation of golf cart paths and other light vehicle or pedestrian pathways, the same system and method herein described may be utilized to create other surfaces as well. For instance, the systems and methods herein described may be utilized to create playground surfaces, mulch beds or other such surfaces that would benefit from a durable, long-lasting and easily applied crumb rubber, or crumb rubber composite surface.

For instance, playground surfaces, which are currently installed by manual application of crumb rubber over the surface to provide a shock absorbent base for children to play on. The current process takes a significant amount of time to construct. Through the use of the systems and methods herein described, the crumb rubber surface may be applied and sealed in approximately half the time and at greatly reduced expense. One of ordinary skill in the art would appreciate that the systems and methods herein described may be modified to suit a particular purpose. For example, in the creation of a playground surface, the crumb rubber layer may need to be of an increased thickness, and the drainage pipe and gravel layer may not be necessary. One of ordinary skill in the art would appreciate that each individual surface may have its own specific requirements, and embodiments of the present invention are contemplated for use with any surface and specific requirements.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A method for creating a golf course cart pathway, said method comprising the steps of:

preparing a sub grade;

excavating one or more drainage trenches in said sub grade;

installing one or more perforated drain pipes in said one or more drainage trenches;

surrounding at least a portion of each of said one or more perforated drain pipes by pea gravel;

layering said sub grade, said one or more drainage trenches and said one or more perforated drain pipes with a layer of gravel;

compacting said layer of gravel;

layering, over said layer of gravel, a thin layer of crumb rubber;

raking said thin layer of crumb rubber;

smoothing said thin layer of crumb rubber;

rolling said thin layer of crumb rubber; and spraying said thin layer of crumb rubber with a pre-polymer.

2. The method of claim 1, wherein each of said one or more drainage trenches are wide enough for receiving said one or more perforated drain pipes.

3. The method of claim 1, wherein each of said one or more perforated drain pipes comprises a four inch or greater drainage pipe.

4. The method of claim 1, further comprising the step of attaching a locating wire to each of said one or more perforated drain pipes.

5. The method of claim 4, wherein said locating wire is a fourteen gauge wire and is configured to allow later location of the one or more perforated drain pipes.

6. The method of claim 1, further comprising the step of curing said pre-polymer for at least 24 hours.

* * * * *